US005943747A

United States Patent [19]

Müller

[11] Patent Number: 5,943,747

[45] Date of Patent: Aug. 31, 1999

[54] DRYING AND SHRINKING OF TEXTILE WEBS USING A TENTERING FRAME EQUIPPED WITH GUIDE BELTS AND HOT AIR NOZZLES

[76] Inventor: Kurt Müller, Hirschparkweg 12, Zofingen, Switzerland, CH-4800

[21] Appl. No.: 08/594,912

[22] Filed: Jan. 31, 1996

[51] Int. Cl.[6] ..... D06C 7/02

[52] U.S. Cl. ..... 26/92; 34/646; 34/444; 34/638

[58] Field of Search ..... 26/106, 92; 34/646, 34/444, 638

[56] References Cited

U.S. PATENT DOCUMENTS

| | | | |
|---|---|---|---|
| 3,605,280 | 9/1971 | Fleissner . | |
| 4,435,909 | 3/1984 | Williamson | 26/92 |
| 4,815,181 | 3/1989 | Dornier et al. | 26/92 |
| 4,899,427 | 2/1990 | Gresens | 26/92 |

FOREIGN PATENT DOCUMENTS

| | | |
|---|---|---|
| A2314979 | 10/1974 | Germany . |
| A2927974 | 1/1981 | Germany . |
| A0148113 | 7/1985 | Switzerland . |
| A346782 | 4/1931 | United Kingdom . |
| A2054683 | 2/1981 | United Kingdom . |

OTHER PUBLICATIONS

European Search Report for EP 95 81 0058, Dated: Aug. 30, 1995, pp. 1–3.

*Primary Examiner*—Andy Falik
*Attorney, Agent, or Firm*—Hazel & Thomas, P.C.

[57] ABSTRACT

An apparatus for continuous drying and shrinking of textile knitted or woven good incorporates at least one drying station that includes several oppositely disposed and oppositely hot-air nozzles which are offset relative to each other and directed into a through-channel defined thereby. At least upper and lower endless rotating, porous guide belts limit the channel above and below. An endless rotary web-tentering frame passing along the through-channel limited by the guide belts conveys a web of material to be treated through the at least one drying station, wherein a first vertical distance between the frame and a lower strand of the upper guide belt and a second vertical distance between an upper strand of the lower guide belt are defined such that, as the apparatus operates, within a predetermined effective range of a hot-air nozzle directed thereon, a web, in a locally limited area, secured in and conveyed by the webtenter frame, comes into contact with a portion of a corresponding guide belt, whereby the lower and/or upper guide belt moves at greater speed than that of the tenter frame. A supply mechanism for conveying the web to be treated to the tenter frame includes a device for securing the material with forward slip to the tenter frame.

16 Claims, 5 Drawing Sheets

DRYING AND SHRINKING OF TEXTILE WEBS USING A TENTERING FRAME EQUIPPED WITH GUIDE BELTS AND HOT AIR NOZZLES

BACKGROUND OF THE INVENTION

The invention relates to a process for the continuous drying and shrinking of textile knitted or woven goods, in which the moist goods to be treated are conveyed along a through-channel formed between at least two endless rotating porous guide belts for the purpose of drying on both sides by means of at least one drying station, comprising oppositely disposed, oppositely acting hot-air nozzles which are offset relative to each other, and also an apparatus for carrying out this process.

Processes of the kind mentioned above are already known, but all have the disadvantage that articles treated in this way are mostly twisted and/or unevenly shrunk, so that they require subsequently to undergo further relatively expensive treatment.

SUMMARY OF THE INVENTION

The problem underlying the present invention is in particular to provide a process lacking this disadvantage, i.e., by the employment of which textile webs of extremely accurate form can be produced with improved uniformity of web structure.

This problem is solved according to the invention by a process for the continuous drying and shrinking of textile knitted or woven goods, in which the moist goods to be treated are conveyed along a through-channel formed between at least two endless rotating porous guide belts for the purpose of drying on both sides by means of at least one drying station, including oppositely disposed, oppositely acting hot-air nozzles which are offset relative to each other, comprising the steps of securing the material with forward slip on an endless tenter frame, moving said material forward through said channel while maintaining a clearance distance in the blower direction, moving said material, transversely tensioned and laterally secured, in the direction of motion and in wave-form through said drying station so that the material to be treated in the blow area of an individual hot-air nozzle comes momentarily to rest on said guide belt facing away from the latter, whereby the lower and/or upper guide belt moves forward more quickly than said tenter frame.

Advantageous further developments of the process according to the invention include separately regulating the rotary speeds of the web clamping devices on the left-hand side and right-hand side of the tenter frame in order to obtain different speeds for each of them.

An even further object of the invention is to provide a process which includes a step of conveying the material, before being placed on said tenter frame, through a width-stretching device.

Further objects of the invention include the additional steps of employing a lower and upper guide belt which include several narrower belts or cables, independent of each other and whose rotary speeds (v1, v2, v3) are preferably individually regulatable; limiting the through-channel by several groups of guide belts, independent of each other and whose rotary speeds (v1, v2, v3) are preferably individually regulatable; maximizing the guide belt rotary speed in the actual shrinking zone; using a web-scanner to individually regulate the driving of the various guide belts; arranging the drive of the various belts or cables side-by-side and parallel to each other, and controlled so that, with knitted goods, the stitches are aligned with each other at a right angle to the moving web and, with woven goods, the weft threads are aligned at a right angle to the moving web and, if necessary, adjusting the degree of gathering or of stretching thereof.

A further object of the invention is to provide an apparatus for carrying out the process for continuous drying and shrinking of textile knitted or woven goods having at least one drying station comprising several oppositely disposed and oppositely-acting hot-air nozzles which are offset relative to each other and directed into a through-channel and also having at least two endless rotating, porous guide belts limiting said channel above and below, an endless rotary web-tentering frame passing along the through-channel limited by the guide belts for conveyance of a web of material to be treated through at least one drying station, and the vertical distance between said frame and the lower strand of at least one upper guide belt, as also between the upper strand of at least one lower guide belt, is such that, as the apparatus operates, within the particular effective range of a hot-air nozzle directed thereon, a web, in a locally limited area, secured in and conveyed by the web-tenter frame, comes into contact with the further distanced guide belt, whereby the lower and/or upper guide belt moves on at greater speed than that of the tenter frame, and the supply means conveying the web to be treated to the tenter frame are so designed as to secure the material with forward slip to the tenter frame.

Further objects of the invention include a width-stretching device for treatment of the web mounted before the tenter frame, which device is provided preferably with at least two rollers, one of which has on its periphery a relief comprising a plurality of elevations and depressions, while the other has on its periphery an at least approximately complementary relief whose elevations fit into the depressions of the aforementioned roller; left-hand and right-hand web-clamping means of the tenter frame comprising an endless chain carrying needles or tenter clips, and in that at least one of the two chains is conveyed through a guide belt and covering channel within the through channel and extending in longitudinal direction of said channel, and which is supported in vertical direction preferably on at least one of the upper and lower guide belts; an adjustable distance between the two guide belts limiting the through-channel in vertical direction; and the efflux direction in at least a part of the shrinking zone of the apparatus is directed obliquely counter to the direction of travel of the web and at an angle ($\alpha$) in the region of 1° to 40° to the vertical, and in that the blower strength and the angle of inclination ($\alpha$) are coordinated in such a manner that, in practice, no significant displacement at any point occurs of the web portions in contact upon the two guide belts.

BRIEF DESCRIPTION OF THE DRAWINGS

The invention will now be described by way of example with reference to the drawings, in which.

DETAILED DESCRIPTION OF THE PREFERRED EMBODIMENT

Figure 1:
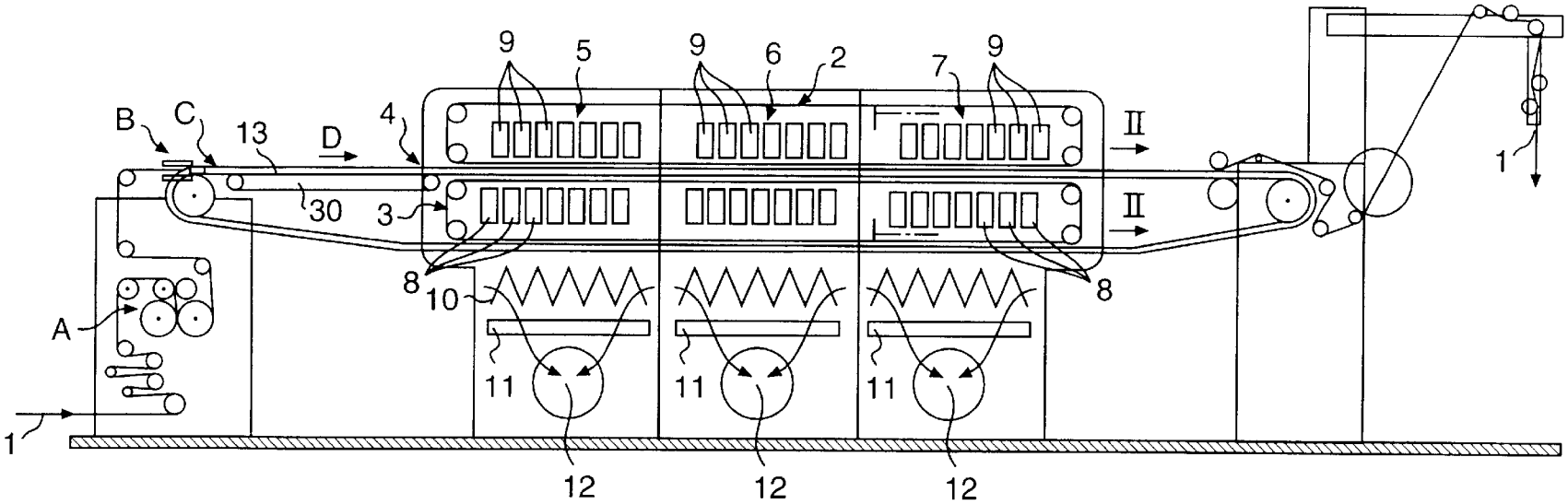
FIG. 1 is a longitudinal section through an embodiment as an example of an apparatus according to the invention.

Referring now to FIG. 1, the moist textile web 1 to be treated is conveyed within a through-channel 4 formed between two endless rotating porous guide belts 2 and 3 so that the web 1 is impacted and dried on both sides at three successive drying stations 5, 6, 7 of known construction.

These drying stations 5, 6, 7 are provided in the known manner with hot-air slit nozzles 8 or 9 which are laterally distanced from each other, which are directed towards the through-channel 4, and which extend at a right-angle to the direction of travel D of the textile web 1 to be treated and over the entire width of the two guide belts 2, 3.

In order to obtain the wave movement in the web 1 travelling along the through-channel 4, the upper hot-air slit nozzles 9 are offset in relation to the lower hot-air slit nozzles 8 in the direction of travel D of said web 1.

After their action on the web 1, the hot air emerging from the hot-air nozzles 8 and 9 is drawn in via air filters 10 and heat-exchangers 11 from the ventilators 12 and, on reheating, is returned to the relevant hot-air nozzles 8 and 9.

Figure 2:
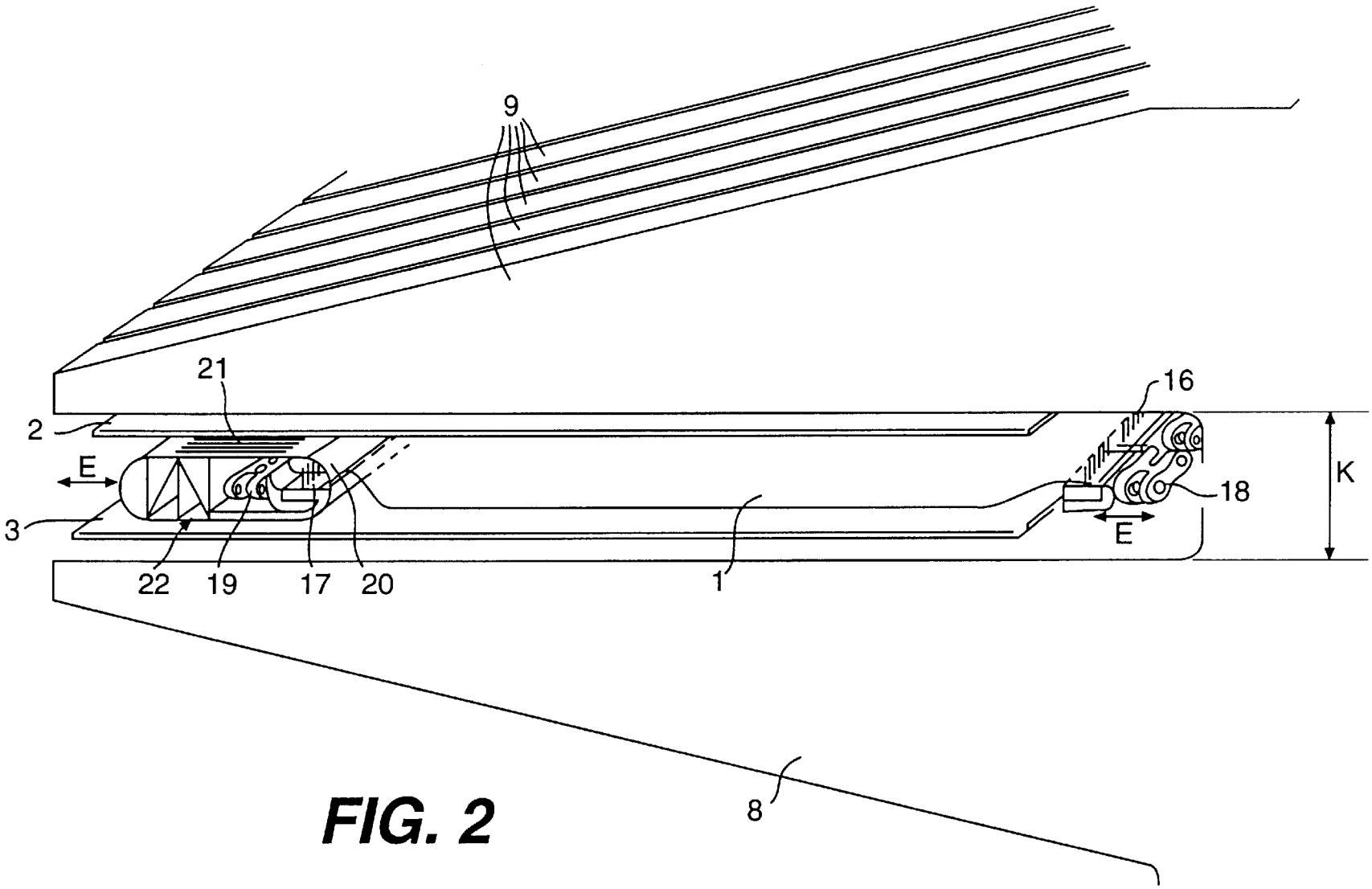
FIG. 2 is a section on the line II—II FIG. 1 and is a perspective view on a larger scale.
Figure 3:
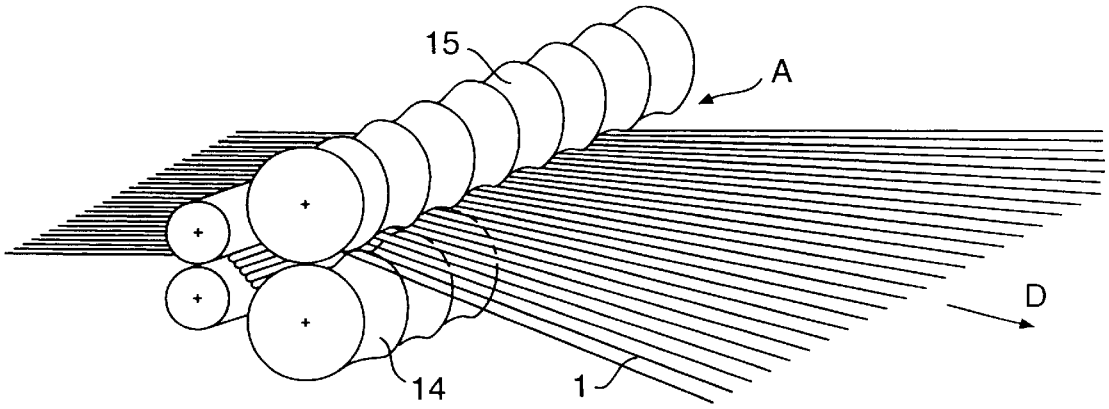
FIG. 3 is a perspective view of the web width-stretching device A in FIG. 1, on a larger scale.

As will be seen especially from FIGS. 1, 2 and 3, in order to obtain the most even stretching of the moist textile web 1 over its entire width, it is conveyed firstly to a width-stretching device A, then to an endless tenter frame 13 moving forward through channel 4 with clearance distance e in the blower direction, and is secured with forward slip at the point B by pinning on the tenter frame 13. The clearing distance e is defined as the distance between securing plane S of the tenter frame 13 and the upper or lower guide belt defined as the 2,3 (See FIG. 2). One way of providing the forward slip is by feeding the material into point B at a speed higher than that of the tenter frame 13.

As will be seen from FIG. 3, the width stretching device A is provided in the known manner with two rotating grooved rollers 14 and 15 leaving a stretching gap between them. After this width-stretching device A, the web is conveyed via several spreader rollers to a pinning unit B.

Figure 5:
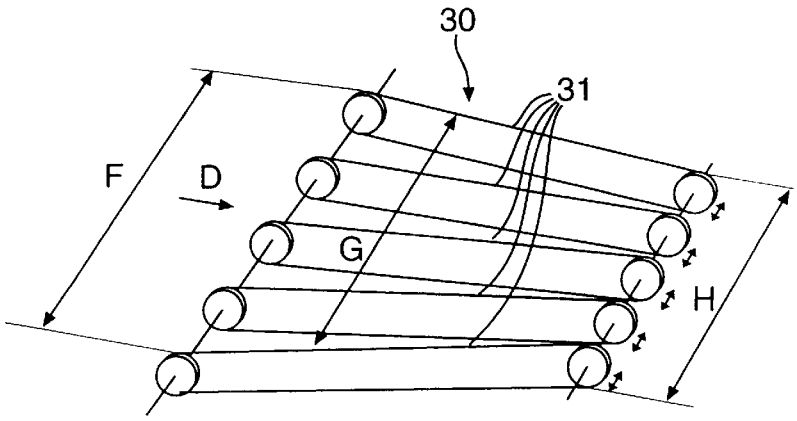
FIG. 5 is a diagrammatic view in perspective of a web-supporting and transport unit which supports the regular narrowing of the web.
Figure 6:
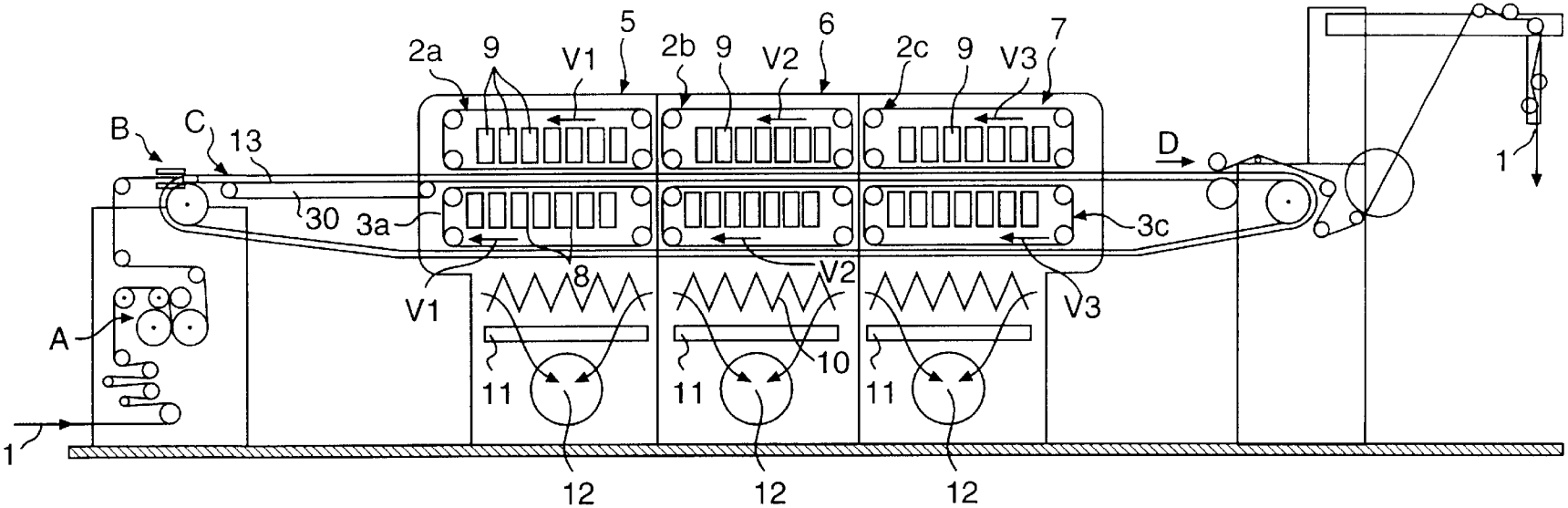
FIG. 6 is a diagrammatic side-elevation view of a further embodiment of an apparatus according to the invention.

After the lateral pinning of the already width-stretched web 1 into the tenter frame 13 by the pinning unit B, the width-stretched web, is held by means of a web-supporting and transporting unit 30 which moves, conically narrowing from an initial width F (see FIG. 5), in the web-supporting plane C, and extends laterally over the entire web width G, to achieve the desired treatment width H, which web 1 is continuously laterally held by the endless tenter frame 13 so as to narrow conically until it is conveyed to the entrance to the drier 5, 6, 7.

In this way, by the narrowing of the web width F to the treatment width H as it enters the drier 5, 6, 7, a most uniform initial web structure is obtained since, during its narrowing, the web 1 lies upon the upper strands of the endless conveyer sides 31, and these latter thus support a uniform narrowing of the web 1 over its entire varying web width G.

Referring to FIG. 2, the endless tenter frame 13 is provided with a web-clamping device 18 or 19 on the left-hand and right-hand side, each formed by an endless chain and provided with needles 16 or 17 for the latter fixing of the web 1, the speed of rotation of said clamps being variable in order to control individually the direction of the weft.

In the embodiment illustrated, one of the two web clamps 18 and 19 in the through-channel 4 passes through a guide and covering channel 20 extending in longitudinal direction of the channel 4 to prevent any damage to the upper guide belt 2 from the needles 17. Moreover, the two web-clamps 18 and 19 are adjustable laterally (see E) in order to adjust the tenter frame 13 to a particular web width. Of course, it is also possible to pass the web-clamp 18 through a guide covering channel similar to 20 between the upper and lower guide belts 2 and 3.

The guide and covering channel 20 is supported vertically on the upper and lower guide belts 2 and 3, and, its contact points 21 and 22 with the latter, it is faced with friction-resistant material, e.g., polytetrafluoroethylene ("TEFLON™)."

By this lateral guidance of the web 1, which is held taught transversely by means of an endless rotating tenter frame 13 passing through the drier, and end product may be obtained which is most uniform in respect of structure, accuracy of dimension and form stability.

Figure 4:
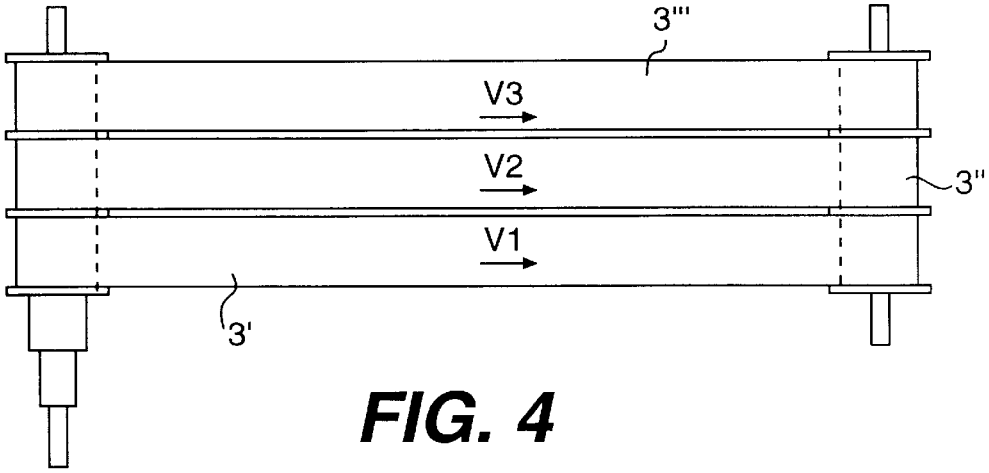
FIG. 4 is a diagrammatic plan view of the upper strands of a lower guide belt unit of a second embodiment as example of an apparatus according to the invention.

In order for example to adjust the weft direction or stitching to a straight line at a right-angle to the longitudinal direction of the web, e.g. when the web 1 is twisted, and/or to achieve over the width of the web a different gathering or stretching effect in order to obtain a more homogeneous end product, it is possible (see FIG. 4), instead of one single upper and lower guide belt 3 or 2, to provide several narrower guide belts 3', 3", 3'", and to regulate their rotary speeds v1, v2, v3 individually with the aid of an opto-electronic web scanner 24 (see FIG. 1) such as is obtainable for example from Mahlo, BRD or Erhard & Leimer, BRD.

In order to effect the gathering or stretching of the web 1 more accurately to a particular density, it is also possible (see FIG. 5), instead of a single upper and lower guide belt 3 or 4, to provide several successive and independent guide belt groups 2*a*, 3*a*; 2*b*, 3*b* and 2*c*, 3*c* and to regulate their rotary speeds v1, v2, v3 individually in groups with the aid of an optoelectronic web-scanning arrangement.

Figure 7:
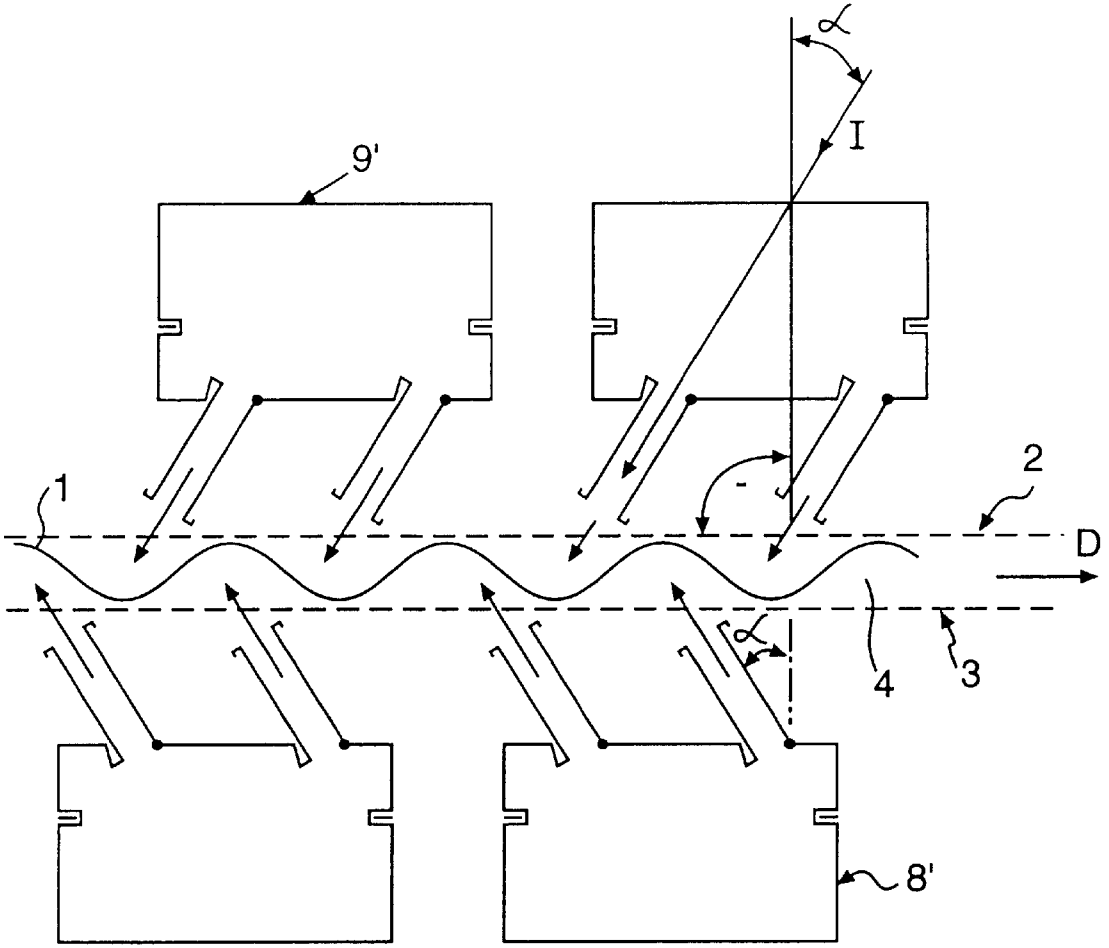
FIG. 7 is a cross-section through a special form of the hot-air nozzles, on a larger scale.

In order to reinforce the shrinking effect in the shrinking zone, it is useful (see FIG. 7) if the efflux direction I from the hot-air nozzles 8 and 9 in this zone is obliquely inclined to the vertical against the direction of travel D of the web, by an angle $\alpha$ in the region of 1°–40°. The blow strength and the angle of inclination $\alpha$ require in this case to be coordinated so that in practice there is no significant displacement of the parts of the web lying in places P in contact with the two guide belts 2 and 3. With this type of arrangement of the hot-air nozzles 8' and 9' in the shrinking zone of the drier, as compared with the normal vertical arrangement thereof, a considerable reinforcement is obtained of the gathering effect on the web 1 of the impact on the particular guide belt 4 or 3.

I claim:

1. A process for the continuous drying and shrinking of textile knitted or woven goods, said process comprising the steps of:

providing at least two upper and lower endless guide belts forming a through-channel therebetween;

providing a drying station that includes oppositely disposed and oppositely acting hot air nozzles that are offset relative to each other in a direction of web travel;

providing an endless tenter frame;

securing a material to be treated with forward slip on said tenter frame;

moving said material to be treated forward through said through-channel while maintaining a clearance distance in a blower direction of said hot air nozzles between a securing plane of said tenter frame and said upper and lower guide belts;

transversely tensioning and laterally securing said material to be treated on said tenter frame;

moving said material to be treated using said tenter frame in a direction of motion of said upper and lower guide belts and in wave form through said drying station so that said material to be treated comes to rest momentarily and alternatingly on one of said upper and lower guide belts; and moving at least one of said upper and lower guide belts in a forward direction at a speed higher than a speed at which said material to be treated is moved using said tenter frame.

2. The process according to claim 1 further comprising the step of separately regulating rotary speeds of web-clamping devices on left-hand and right-hand sides of said tenter frame in order to obtain different speeds for each of said devices.

3. The process according to claim 1, further comprising the step of conveying said material, before being placed on said tenter frame, through a width-stretching device.

4. The process according to claim 3 further comprising the steps of:

further conveying the width-stretched material, after leaving the width-stretching device and lateral fixing in the tenter fame, by mans a web-supporting and transporting unit which moves, narrowing conically as seen from the web-supporting plane, and extends over an entire varying web width, to reach a pre-selected treatment width, and providing said transport unit with several endless conveyor cables or belts arranged laterally one beside the other with a gap between and extending in the direction of travel.

5. The process according to claim 1, further comprising the steps of:

providing as the lower and upper guide belts several narrower belts or cables which are independent of each other, and regulating rotary speeds (v1, v2, v3) of said guide belts individually.

6. The process according to claim 1, further comprising the steps of:

providing the through-channel with several groups of guide belts that are independent of each other, and regulating rotary speeds (v1, v2, v3) of said guide belts individually.

7. The process according to claim 6 further comprising the steps of:

determining an actual shrinking zone within said through-channel and along said guide belts; and maximizing rotary speeds of said guide belts in the actual shrinking zone.

8. The process according to claim 5 wherein the step of regulating the various guide belts individually includes regulating the guide belts with the aid of a web-scanner.

9. The process according to claim 6 wherein the step of regulating the rotary speeds of the various guide belts includes regulating the guide belts individually with the aid of a web-scanner.

10. The process according to claim 9 wherein the step of providing the various belts or cables includes arranging the belts or cables side-by-side and parallel to each other, and further comprising the steps of:

controlling said guide belts such that, with knitted goods, the stitches are aligned with each other at a right angle to the moving material to be treated and, with woven goods, the weft threads are aligned at a right angle to the moving material to be treated.

11. A process according to claim 1 wherein an efflux direction defined in at least a part of a shrinking zone is directed obliquely opposite a direction of travel of said material to be treated and at an angle of inclination ($\alpha$) in the range of 1° to 40° to the vertical, said process further comprising the step of:

coordinating a blower strength of said hot-air nozzles with the angle of inclination ($\alpha$) so as to prevent significant displacement of portions of said material to be treated contacting the upper and lower guide belts.

12. An apparatus for continuous drying and shrinking of textile knitted or woven goods, comprising:

at least one drying station including several oppositely disposed and oppositely acting hot-air nozzles which are offset in a direction of fabric movement through said drying station relative to each other and directed into a through-channel defined thereby, at least upper and lower endless rotating, porous guide belts forming a through-channel therebetween, and an endless rotary web-tentering frame passing along the through-channel limited by the guide belts for conveying a web of material to be treated through said at least one drying station, wherein a first vertical distance between said frame and a lower strand of said upper guide belt and a second vertical distance between an upper strand of said lower guide belt are defined such that, as the apparatus operates, within a predetermined effective range of a hot-air nozzle directed thereon, a web, in a locally limited area, secured in and conveyed by the web-tenter frame, comes into contact with a portion of a corresponding guide belt, whereby the lower and/or upper guide belt moves at greater speed than that of the tenter frame, and supply means for conveying the web to be treated to the tenter frame, said supply means including means for securing the material with forward slip lo the tenter frame.

13. An apparatus according to claim 12 further comprising a width-stretching device for treatment of the web mounted before the tenter frame, said device including at least first and second rollers, the first roller having on its periphery a relief comprising a plurality of elevations and depressions, the second roller having on its periphery an at least approximately complementary relief whose elevations fit into the depressions of the first roller.

14. An apparatus according to claim 12, wherein the tenter frame includes left-hand and right-hand web-clamping means, each including an endless chain carrying at least one of needles and tenter clips, the endless chain of at least one of said left-hand and right-hand web-clamping means being operatively connected so as to be conveyed through a guide and a covering channel defined within the through-channel and extending in a longitudinal direction of said through-channel, and the endless chain further being supported in a vertical direction on at least one of the upper and lower guide belts.

15. An apparatus according to claim 12 further comprising:

means for adjusting a distance between the upper and lower guide belts limiting the through-channel in a vertical direction.

16. An apparatus according to claim 12 wherein an efflux direction defined in at least a part of a shrinking zone of the apparatus is directed obliquely opposite a direction of travel of the web and at an angle of inclination ($\alpha$) in the range of 1° to 40° to the vertical, said apparatus further comprising:

means for coordinating a blower strength of said hot-air nozzles with the angle of inclination ($\alpha$) so as to prevent significant displacement of portions of the web contacting the upper and lower guide belts.

* * * * *